US005752477A

United States Patent [19]

Dabadie

[11] Patent Number: 5,752,477

[45] Date of Patent: May 19, 1998

[54] TWO-STROKE ENGINE WITH VALVE MOTION CONTROL MEANS

[75] Inventor: Jean-Charles Dabadie, Rueil-Malmaison, France

[73] Assignee: Institut Francais du Petrole, Rueil Malmaison, France

[21] Appl. No.: 799,760

[22] Filed: Feb. 12, 1997

[30] Foreign Application Priority Data

Feb. 12, 1996 [FR] France ..... 96 02048

[51] Int. Cl.[6] ..... F02B 75/02

[52] U.S. Cl. ..... 123/65 VB; 123/90.14

[58] Field of Search ..... 123/65 VB, 65 V, 123/90.14, 90.1

[56] References Cited

U.S. PATENT DOCUMENTS

| | | | |
|---|---|---|---|
| 1,361,109 | 12/1920 | Spohrer | 123/90.14 |
| 2,334,688 | 11/1943 | Norton | 123/65 VB |
| 4,995,350 | 2/1991 | Kumagai et al. | 123/90.14 |
| 5,005,537 | 4/1991 | Maissant | 123/65 VB |
| 5,277,222 | 1/1994 | Clarke | 123/90.14 |
| 5,586,523 | 12/1996 | Kawahara et al. | 123/65 VB |

FOREIGN PATENT DOCUMENTS

| | | |
|---|---|---|
| 2 656 653 | 7/1991 | France . |
| WO96/07817 | 3/1996 | WIPO . |

*Primary Examiner*—David A. Okonsky
*Attorney, Agent, or Firm*—Antonelli, Terry, Stout & Kraus, LLP

[57] ABSTRACT

The present invention relates to a two-stroke engine comprising at least a cylinder (111) in which a piston (112) moves and one end of which communicates with a pump sump (115) crossed by the crankshaft (114) of the engine, a capacity under pressure (87) opening at one end into said pump sump, at the other end into the combustion chamber (113) of cylinder (111), a valve (86) providing an intermittent seal between chamber (113) and capacity (87), a means (88) for carburetting the gases passing through said capacity (87), a means (82) for controlling the motion of said valve (86), comprising a supple membrane (89) separating a first chamber (95*a*) and a second chamber (95*b*), said membrane being connected to the valve rod. According to the invention, said engine further comprises a first means (92) for connecting the second chamber (95*b*) to the cylinder, the means being intended to retard the opening of said valve (86) by controlling the pressure in said chamber (95*b*).

7 Claims, 6 Drawing Sheets

TWO-STROKE ENGINE WITH VALVE MOTION CONTROL MEANS

FIELD OF THE INVENTION

The present invention relates to the field of two-stroke engines with controlled pneumatic injection.

More precisely, the present invention relates to the control and to the monitoring of the pneumatic injection of fuel in single-cylinder or multicylinder two-stroke engines.

BACKGROUND OF THE INVENTION

A conventional way to control pneumatic injection consists in connecting the valves to a camshaft. This purely mechanical solution provides little flexibility since each cam imposes a precise motion of a valve and, furthermore, the camshaft supporting several cams, it is a given general motion that is imposed from the origin by the cams. This technology thus generates a general control common to all of the valves of the camshaft. Adjustment is difficult and a problem with one of the cams and/or the valves can have repercussions on all the other parts involved.

There are well-known more flexible control systems based notably on pressure variations between various chambers cooperating with the motion of the valve.

Thus, French patents FR-2,656,653 and FR-2,656,656 describe multicylinder two-stroke engines in which pneumatic fuel injection is achieved by means of pressure differences between various chambers. This prior art specifically relates to engines provided with several cylinders since the pressure differences are created thanks to the angular offset existing between the cycles of the various cylinders.

The aim of the present invention is to simplify this technology and particularly to allow to apply it to single-cylinder engines, which cannot be done with the aforementioned prior art.

In a general way, the object of the invention is to use the different pressure variations inherent in the working of a cylinder in order to actuate automatically a pneumatic fuel injection device in this cylinder. In other words, the invention is aimed at controlling automatically the opening and the closing of a valve at each engine revolution, at precise and predetermined times, without using a mechanical control means such as a camshaft. French patent application EN.94/10,782, opposable to the present application on an novelty basis only, discloses an engine having notably this characteristic. However, unlike the present invention, this prior solution applies to single-cylinder engines or to engines running totally independently of each other. Besides, as explained hereafter, the connections and the pressure sources used are different.

One of the problems at the root of the present invention is thus linked with the control of the pneumatic injection. The present invention aims at deferring the pneumatic injection and more precisely at retarding it at each engine cycle in relation to an engine according to the prior art.

Furthermore, engines such as those described for example in the aforementioned patent application EN.94/10,782 or in French patent application FR-2,656,653 are equipped with a flange placed in the pump sump in order to control the air flow rate necessary for pneumatic injection.

These flanges are parts added to the engine, as a result of which it is more expensive and precise adjustments are required. The present invention provides a simpler solution that requires no flange for controlling the air flow rate.

Besides, the pressures being taken, according to the aforementioned prior art, in the pump sump, they are not always sufficient notably for high speeds and/or loads.

In relation to patent application EN.94/10,782, there is a problem linked with the transit time of the gases in the lines connecting the pump sump to the injection means, this problem being all the more marked as the engine speed is higher.

The problems mentioned above, as well as others, can be solved according to the present invention.

SUMMARY OF THE INVENTION

The present invention thus relates to a two-stroke engine comprising at least:

- a cylinder in which a piston moves and one end of which communicates with a pump sump crossed by the crankshaft of the engine,
- a capacity under pressure opening at one end into the combustion chamber of the cylinder,
- a valve providing an intermittent seal between the chamber and the capacity,
- a means for carburetting, the gas passing, through said capacity,
- a means for controlling the motion of said valve comprising a supple membrane separating a first and a second chamber, said membrane being connected to the valve rod.

The engine according to the invention further comprises a first connection means between the second chamber and the cylinder, allowing to retard the opening of the valve by controlling the pressure in said chamber.

Preferably, the engine according to the invention further comprises a second connection means between the first chamber and the cylinder, said second connection having a greater length than said first connection.

Said second connection advantageously exhibits a branch connection in relation to the first connection.

In case the engine according to the invention comprises several cylinders, said second connection is provided between the first chamber of the means for controlling the motion of a valve and a second cylinder.

According to an interesting feature of the invention, the engine further comprises a second connection means that opens at one end into said pump sump and at the other end into said first chamber.

Furthermore, the engine according to the invention can comprise a third connection means between the pump sump and the first connection means.

Without departing from the scope of the present invention, a third connection means can be provided between the first and the second connection means.

BRIEF DESCRIPTION OF THE DRAWINGS

Other features and advantages of the invention will be clear from reading the description hereafter, given by way of non limitative examples, with reference to the accompanying drawings in which.

DESCRIPTION OF THE PREFERRED EMBODIMENTS

Figure 1:
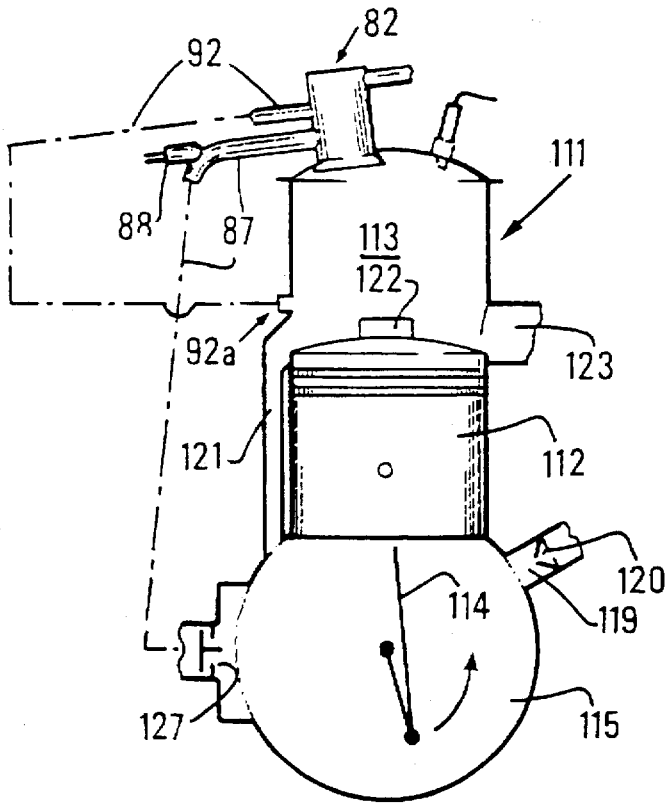
FIG. 1 and 1A are a simplified longitudinal section of a first embodiment of the invention.
Figure 1A:
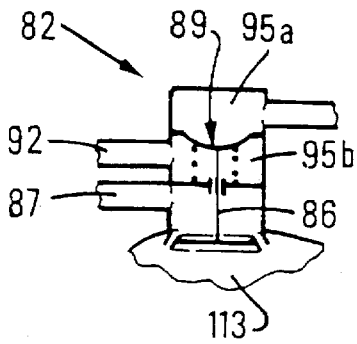

FIG. 1 shows, by means of a simplified longitudinal section, a two-stroke engine equipped with a means 82 for controlling the motion of a valve. More precisely, means 82 is placed on the cylinder head of the engine. This means is described, as for the structure thereof, for example in patent application EN.94/10,782.

For a better understanding of the invention, it may be reminded here that means 82 mainly comprises, in addition to its casing (bearing no reference number) fastened to the cylinder head, a supple membrane 89 that separates two chambers **95*a* and 95*b* subjected to different pressures as will be explained hereafter. Valve 86, whose motion is controlled by means 82, comprises a head resting on its seat in closed position. The valve rod is connected to the supple membrane 89** itself fastened on the periphery thereof to the inner wall of the casing.

A first connection means opens into one of the chambers, **95*b***, also referred to as second chamber or lower chamber in the description hereafter.

A second connection means opens into the other chamber **95*a***, also referred to as upper chamber or first chamber in the description hereafter.

A third line 87 (or capacity) opens onto the base of valve 86 and serves to carry a fuel mixture that is injected into the combustion chamber when valve 86 opens.

A return spring is inserted between the supple membrane 89 and the upper surface of the cylinder head in order to help the membrane to act against the pressure in upper chamber **95*a* and in capacity 87**.

Conventionally, a piston 112 moves in cylinder 111 that comprises a to combustion chamber 113. Said cylinder 111 communicates at the lower end thereof with a pump sump 115.

Pump sump 115 conventionally comprises an air inlet adjutage 119 on which a clapper valve 120 is placed.

The fresh air introduced into pump sump 115 and compressed by piston 112 is injected into cylinder 111 by means of transfer lines such as 121 opening into the cylinder by ports 122. The burnt gases are discharged from cylinder 111 through a line 123.

Line 87 opens, at its end 127 opposite that opening into control device 82, directly into pump sump 115.

Port 127 is preferably controlled by a non-return valve or by any other means capable of sealing this port as soon as the pressure in pump sump 115 becomes lower than the pressure in line 87 that is thus used as a pressure storage capacity.

According to the invention, line 92 that communicates at one end thereof with the chamber **95*b* of device 82 opens into cylinder 113** at the other end thereof.

Preferably, line 92 opens into cylinder 113 at a level close to exhaust line 123. The opening and the closing of line 92 are thus controlled by the motion of the piston, approximately at the same time as the opening and the closing of exhaust line 123. The level depends on the pressure that is desired in the chambers.

According to this embodiment, upper chamber **95*a* is open during induction, therefore at a rather constant pressure. It may also be closed. Its pressure then depends on the position of membrane 89, i.e. on the pressure in the second chamber 95*b***.

Figure 2:
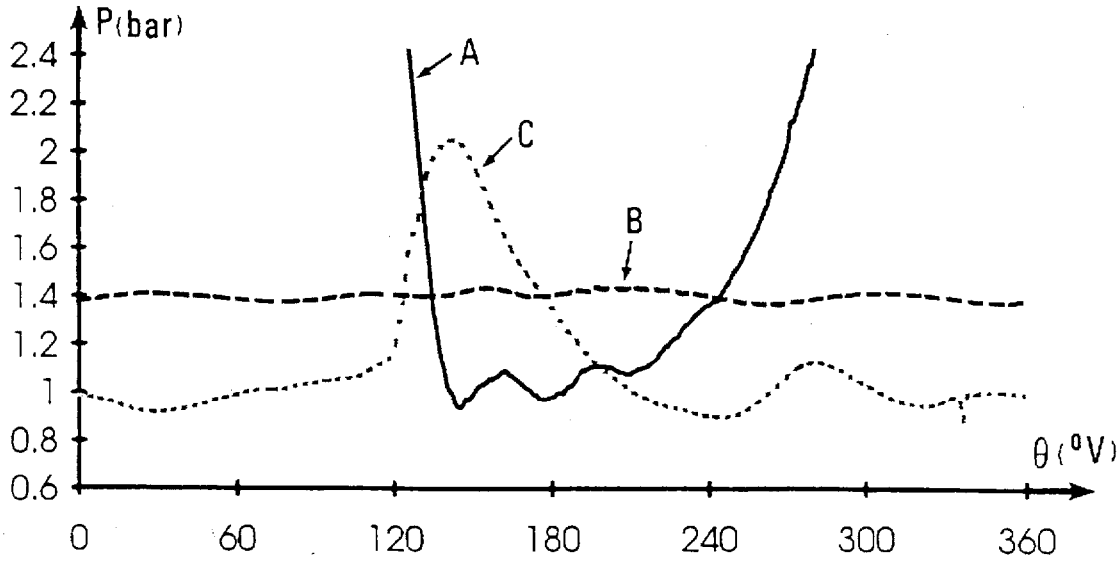
FIG. 2 is a diagram of the pressures obtained in an engine according to FIG. 1.

The pressure in lower chamber **95*b* follows the variations shown in FIG. 2 by means of dotted curve B. This figure also represents the pressure in cylinder 113 (curve A in solid line) and the pressure in capacity 87 (curve C) for the fuel mixture; the last-mentioned pressure being close to the maximum pressure prevailing in pump sump 115**.

For all the pressure diagrams disclosed here (i.e. FIGS. 2, 5, 7, 9, 11 and 13), the pressure (P) laid off as ordinate is expressed in bars and the angle of rotation of the crankshaft (θ) is expressed in degrees CA (°V).

The evolution of said pressures is explained by the operation as follows

When piston 112 moves down in cylinder 111, it uncovers line 92 at the level of its port **92*a*** on the cylinder: the angle is thus about 105° CA.

A pressure wave leaves the cylinder and gets to lower chamber **95*b*, quickly and with little pressure loss; the length of line 92** is rather short.

Without the present invention, the valve would start opening at about 120, 130° CA. According to the present invention, the valve opens only at about 180° CA. This late opening depends on the level at which line 92 is connected to the cylinder. It also depends on the length of said line: it is very short here (about 15 cm), in any case shorter than in the prior art.

Finally, the opening time of valve 86 depends on the dimension (surface area) of membrane 89 and on the strength of the associated return spring.

Injection is completed when the cylinder pressure becomes greater than the pressure in capacity 87.

Figure 3:
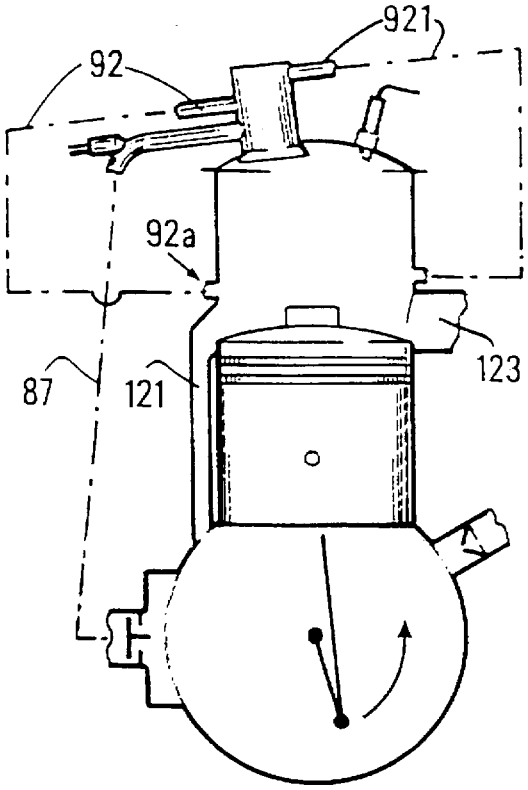
FIG. 3 is a simplified longitudinal section of a second embodiment of the invention.

FIG. 3 illustrates an embodiment of the invention that is different from the first one in the addition of a line 921 that opens at one end into cylinder 111, for example at the same level as line 92.

The length of line 921 is greater than that of line 92 so that the pressure wave coming from cylinder 111 reaches the upper chamber **95*a* after the arrival in 95*b* of that from line 92**.

Figure 5:
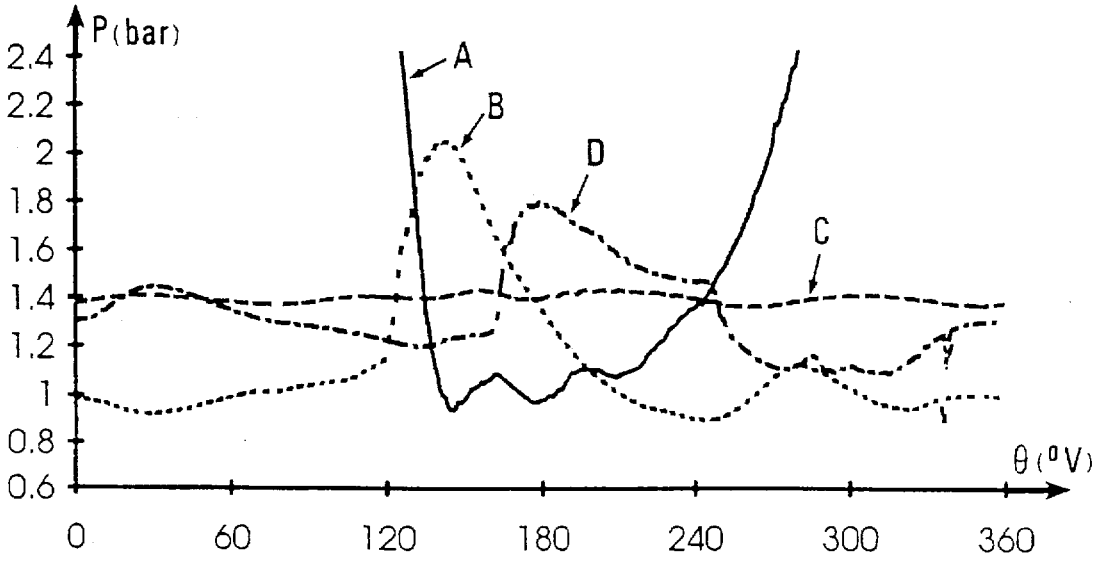
FIG. 5 is a diagram of the pressures obtained in an engine according to FIGS. 3 or 4.

FIG. 5 illustrates this phenomenon. In this figure, curve B relates to the pressure variation in the lower chamber, and curve D to the pressure variation in the upper chamber. FIG. 5 shows that the arrival of the pressure wave in lower chamber **95*b*, which corresponds to a great pressure rise, occurs at about 120° CA. The arrival of the pressure wave in upper chamber 95*a*, which is translated into a great pressure increase, only occurs at about 160° CA. It is thus late in relation to the pressure wave in the lower chamber, this difference being notably due to the fact that line 921 is longer than line 92**.

Furthermore, the shape of the pressure wave in the upper chamber is different from that in the lower chamber; this is due to the fact that the valve starts opening.

The volume of the upper chamber therefore increases considerably (in proportion) and the maximum pressure reached is substantially below that of the chamber.

The additional line 921 has little influence on the injection duration, but it influences the amplitude of the valve motion since it "adds" a pressure to that of the upper chamber. This additional force is interesting because it allows to use a spring of greater stiffness, which facilitates the closing of the valve.

Figure 4:
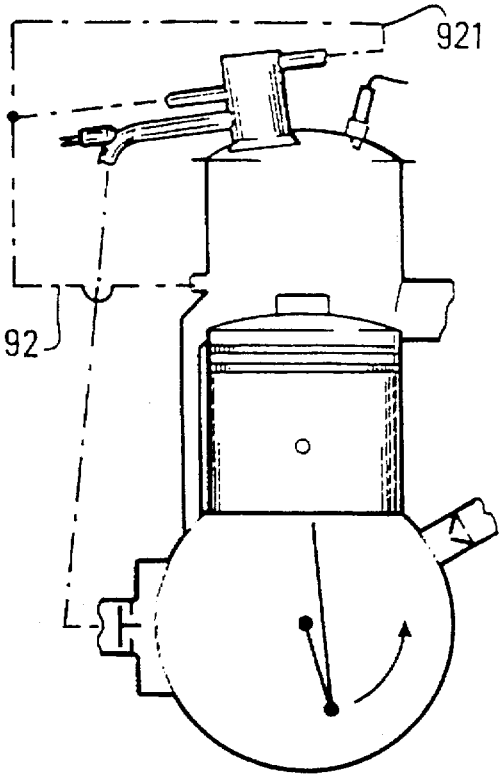
FIG. 4 is a simplified longitudinal section of a third embodiment of the invention.

FIG. 4 illustrates an embodiment that is very close to that of FIG. 3, the difference being that the additional line 921 opens onto line 92 instead of a connection on the combustion chamber. The effect is the same as that of FIG. 3. FIG. 5 thus illustrates the running of the engine according to FIG. 4. It therefore requires no further comments.

Figure 6:
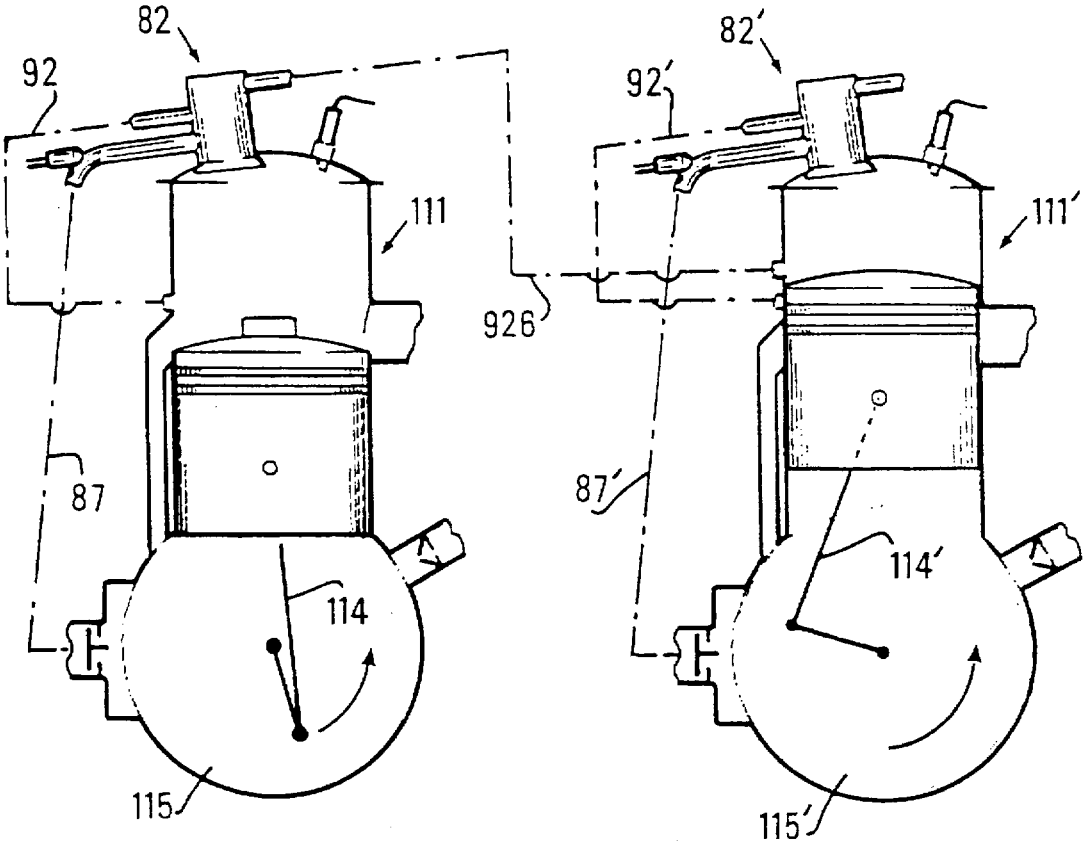
FIG. 6 is a simplified view of two cylinders of an engine according to another embodiment of the invention.
Figure 7:
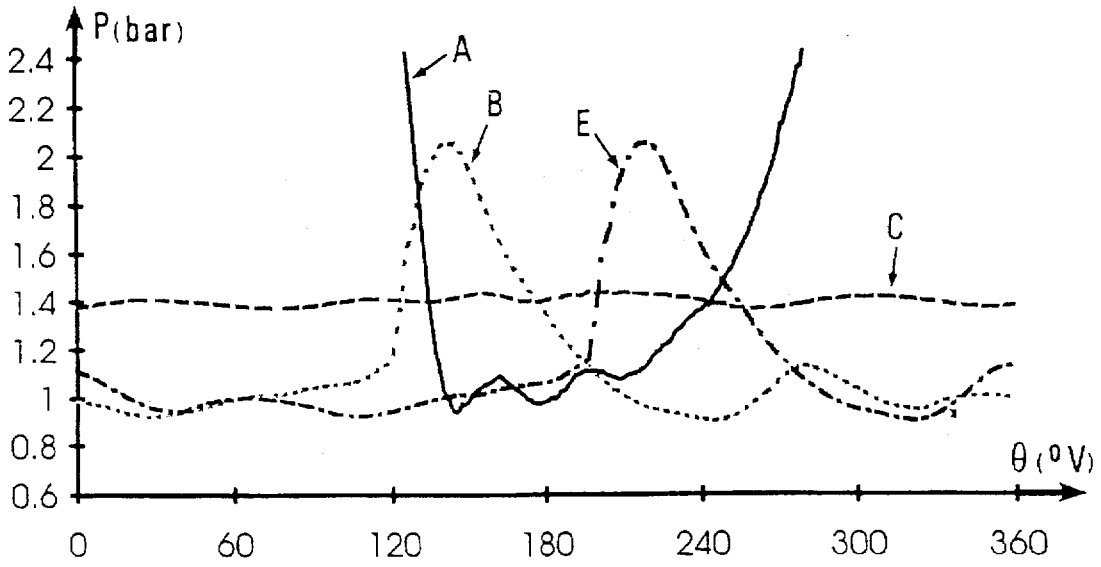
FIG. 7 is a diagram of the pressures obtained in an engine in accordance with FIG. 6, FIG. 8 relates to an engine according to a particular embodiment of the invention.

FIGS. 6 and 7 relate to an embodiment of the invention according to which at least two cylinders are used.

The upper chamber 95*a'* of one of the cylinders is connected, via a line 926, to another cylinder 111'. This other cylinder is also equipped with a valve assistance means 82' whose lower chamber 95*b'* is connected to said cylinder.

Several cylinders may thus be connected. One thus takes advantage of the angular offset between the cylinders.

FIG. 7 illustrates the effect of this offset. In the upper chamber (curve E), the pressure wave arrives with a delay of about 90° CA in relation to the lower chamber (curve B). This delay is due to the angular offset between the two cylinders. The delay can be controlled by means of the length of line 926 and by the position of the connection on the other cylinder 111'.

Using the pressure coming from another cylinder allows to use a shorter line (926) than with a single cylinder (line 921 for example).

The pressure signal coming from the cylinder is therefore less attenuated and it lasts for a shorter time. FIG. 7 shows very well the effect of the line length on the duration of the signal. The length of the pressure wave of curve E is shorter than that of the pressure wave of curve D in FIG. 5. In FIG. 7, the pressure peak of curve E "lasts" only about 60° CA whereas in FIG. 5 the pressure peak of curve D extends over 100° CA. Moreover, with a shorter line, the effect of the speed will be less significant: the transit time of the pressure signal expressed in seconds does not vary much with the speed, but the variation is great when it is expressed in degrees CA.

Figure 8:
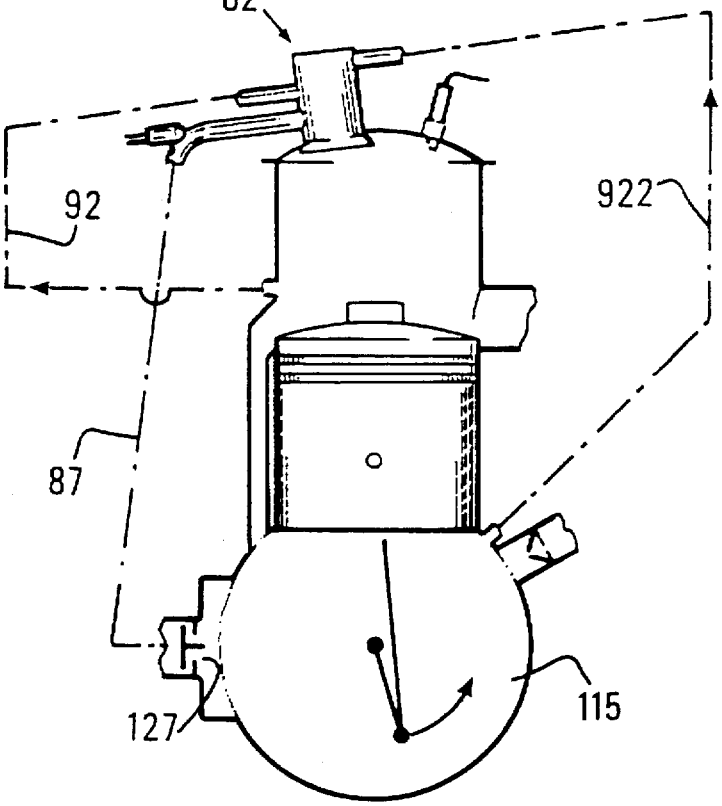
Figure 9:
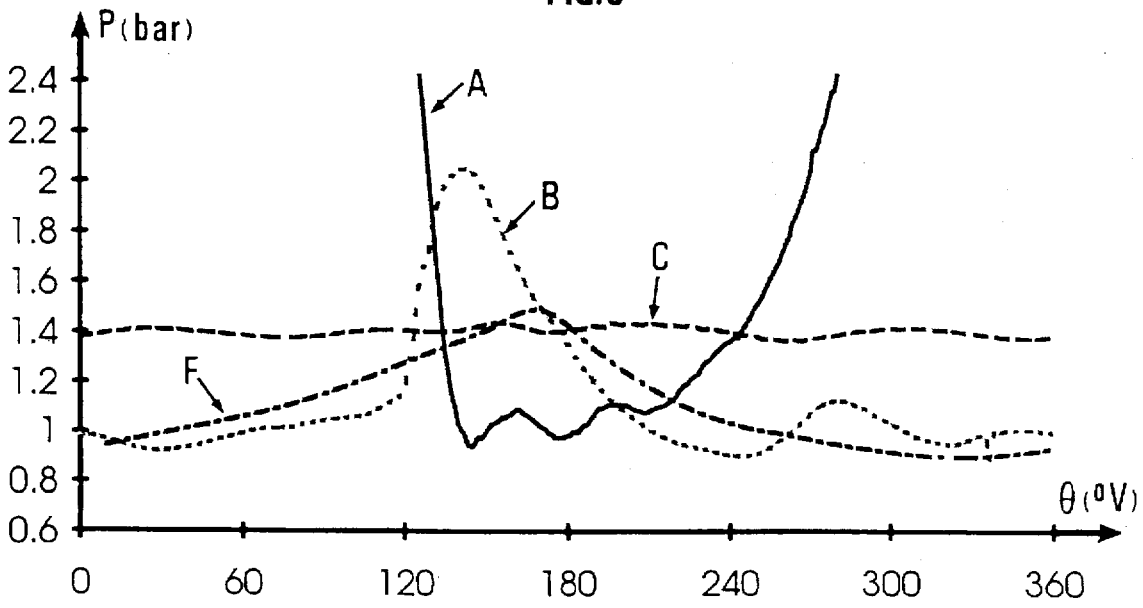
FIG. 9 is a diagram of the pressures obtained in an engine according to FIG. 8.

FIG. 8 shows a two-stroke engine comprising the same elements as that of FIG. 1 and comprising also an additional line 922 opening on the one hand into upper chamber 95*a* and on the other hand into pump sump 115. The additional line 922 is longer than line 92 and the pressure diagram shown in FIG. 9 is obtained. The latter is similar to that of FIG. 2, curves A, B and C being the same. The additional curve F corresponds to the pressure in the upper chamber 95*a* connected to pump sump 115. The pressure wave is different from that in the lower chamber. The pressure peak occurs in the lower chamber at about 130° CA and in the upper chamber at about 170° CA. Besides, the maximum value of the pressure in the upper chamber is about 1.4 bar. It is very much below the maximum value in the lower chamber (above 2 bars).

Thus, with a suitable dimensioning of the membrane and of the spring, valve 86 starts opening when the pressure in the upper chamber is above that in the lower chamber, i.e. in the region of 180° CA. Without this assistance, the opening of the valve starts at about 140° CA.

The end of the injection is at about 240° CA when the pressure in the cylinder becomes substantially greater than the pressure in capacity 87.

This configuration is more suited for high-speed running because:

in relation to the embodiment of FIGS. 1 and 2, the pressure difference between the upper chamber and the lower chamber is greater, in relation to the embodiments illustrated by FIGS. 3, 4 and 5, the embodiment according to FIG. 8 allows to have shorter transit times in the second connection means.

Figure 10:
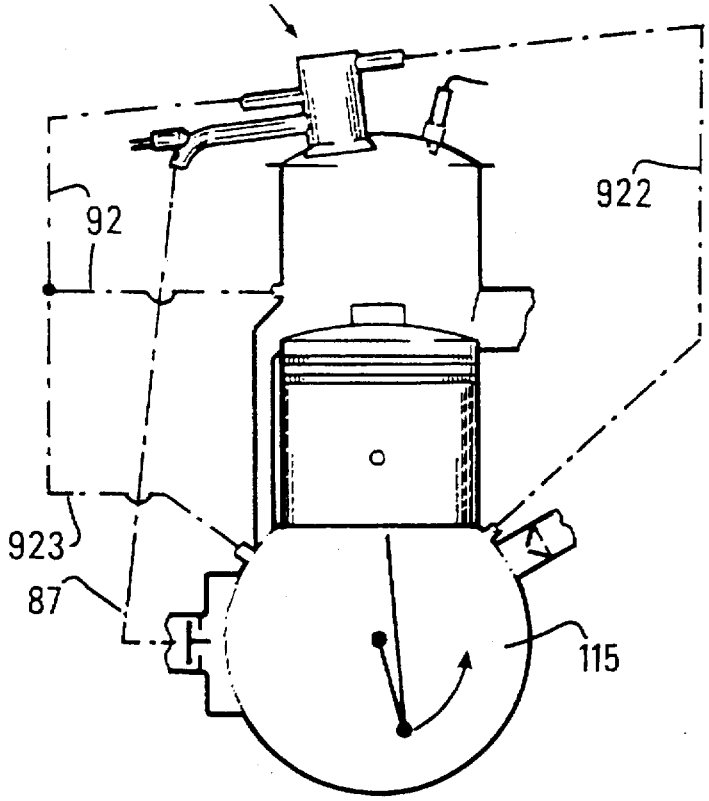
FIG. 10 illustrates, by means of a simple longitudinal section, a specific embodiment of the invention.

FIG. 10 illustrates an embodiment close to that of FIG. 8; a line 923 has been added to connect pump sump 115 to line 92.

Figure 11:
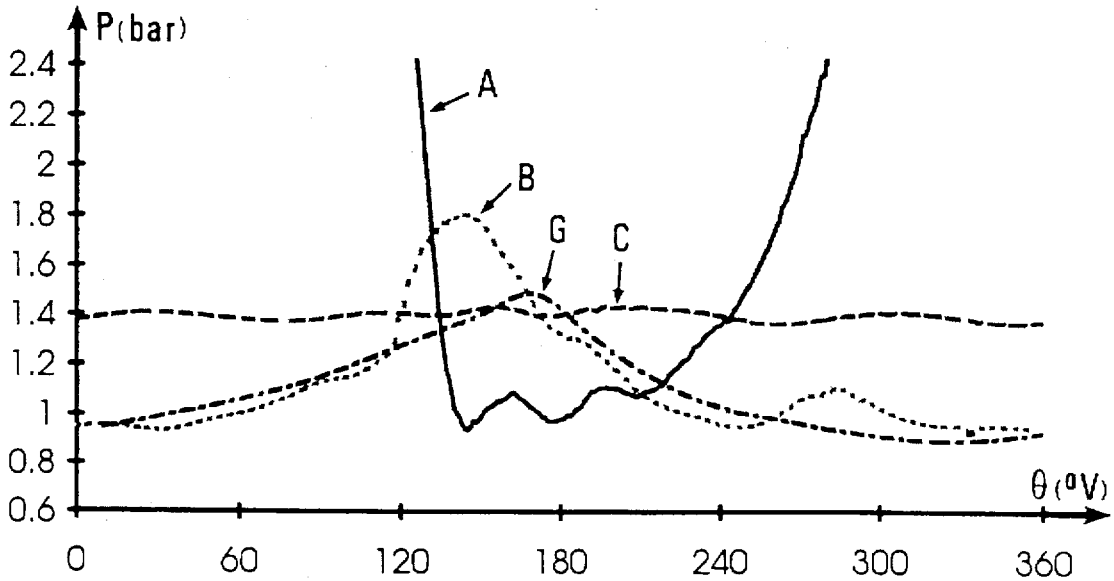
FIG. 11 is a diagram of the pressures obtained in an engine according to FIG. 10.

The pressure evolutions A, B, C and G according to FIG. 11 are obtained. These pressures are very much similar to those obtained in FIG. 9. It may however be noted that the pressure peak in the lower chamber (curve B) decreases and changes from about 2 bars to 1.8 bars. Similarly, the experimental results show a decrease in the temperature of the gases in the lower chamber. This last-mentioned factor can be important for the life of membrane 89.

The injection time remains substantially the same as in the previous instances.

Figure 12:
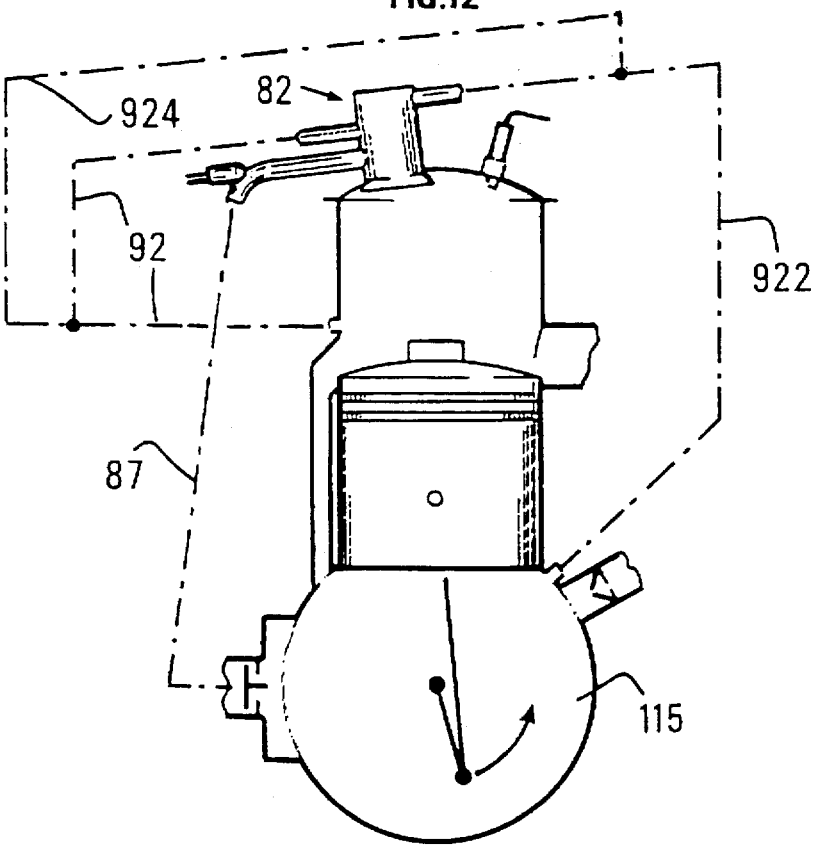
FIG. 12 illustrates, by means of a longitudinal section, an engine according to the invention.
Figure 13:
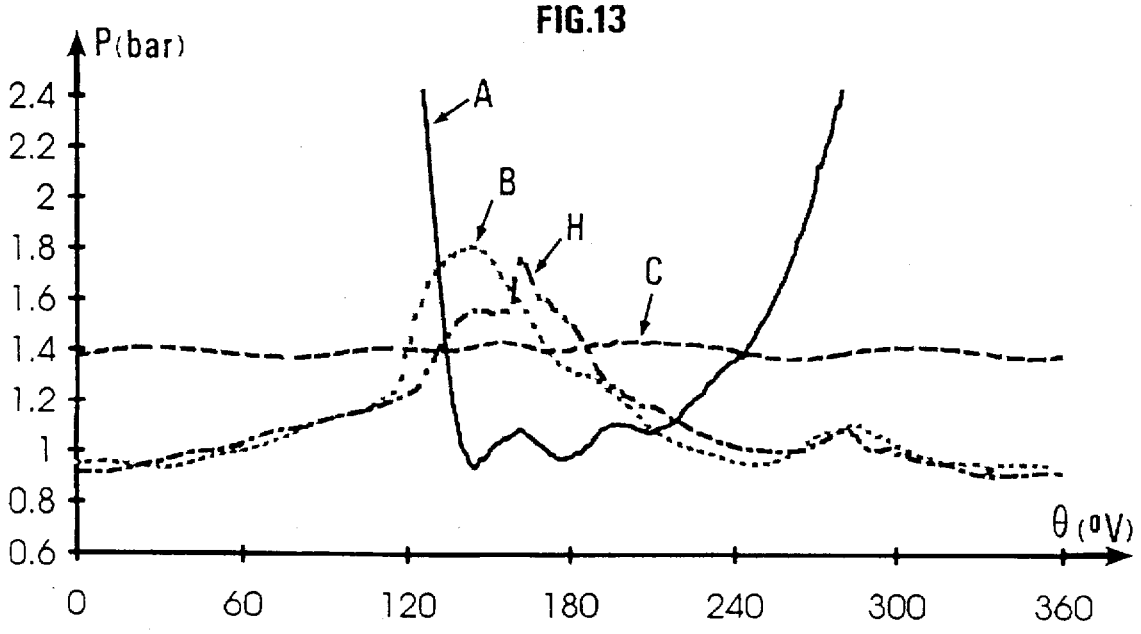
FIG. 13 is a diagram of the pressures obtained in an engine according to FIG. 12.

Another embodiment of the invention is illustrated in FIG. 12 with the pressures according to FIG. 13. Basically, this embodiment takes up that of FIG. 8; it comprises the same lines.

It additionally comprises a connection 924 between line 92 and line 922. This modifies the evolution of the pressure in upper chamber 95*a*, corresponding to the curve H in FIG. 13. A sudden pressure increase can in fact be observed on curve H at about 170° CA. This is due to the arrival of the pressure wave coming from the cylinder via connection 924. The opening of the valve starts on the arrival of this wave, i.e. at about 170° CA. The time of this opening is determined by the lengths of the various lines 92, 922, 924.

The advantage of this embodiment in relation to that described in connection with FIGS. 10 and 11 consists in obtaining a greater pressure difference between the upper chamber and the lower chamber. The force acting upon membrane 89 is therefore greater, hence the possible use of a spring of higher stiffness.

I claim:

1. A two-stroke engine comprising at least:

a cylinder in which a piston moves and one end of which communicates with a pump sump crossed by the crankshaft of the engine, said cylinder having an exhaust port, a capacity under pressure opening at one end into said pump sump, at the other end into the combustion chamber of cylinder, a valve having a valve rod providing an intermittent seal between the combustion chamber and the capacity, a means for carburetting the gases passing through said capacity, a means for controlling the motion of said valve, comprising a supple membrane separating a first chamber and a second chamber, said membrane being connected to the valve rod, further comprising a first connection means between the second chamber and the cylinder substantially at a level of the exhaust port, the first connection means being intended to retard the opening of said valve by controlling the pressure in said second chamber.

2. An engine as claimed in claim 1, further comprising a second connection means between the first chamber and said cylinder, said second connection means having a greater length than said first connection means.

3. An engine as claimed in claim 2, wherein said second connection means is a branch connection in relation to the first connection means.

4. An engine as claimed in claim 2, wherein said second connection means is provided between the first chamber of a first cylinder and a second cylinder.

5. An engine as claimed in claim 1, further comprising a second connection means opening at one end into said pump sump and at the other end into said first chamber.

6. An engine as claimed in claim 5, further comprising a third connection means between the pump sump and the first connection means.

7. An engine as claimed in claim 5, further comprising a fourth connection means between the first connection means and the second connection means.

* * * * *